United States Patent [19]

Speich et al.

[11] 4,442,869

[45] Apr. 17, 1984

[54] APPARATUS FOR THE OPTICAL RETENTION OF THE TWO RECIPROCATINGLY DRIVEN CONTROL ELEMENTS OF THE SHED FORMING ARRANGEMENT ASSOCIATED WITH A LOOM

[75] Inventors: Francisco Speich, Gipf-Oberfrick; Robert Bucher, Frick, both of Switzerland

[73] Assignee: Textilma AG, Hergiswil, Switzerland

[21] Appl. No.: 330,328

[22] Filed: Dec. 14, 1981

[30] Foreign Application Priority Data

Dec. 22, 1980 [CH] Switzerland ..... 9530/80

[51] Int. Cl.[3] ..... D03C 1/06

[52] U.S. Cl. ..... 139/71

[58] Field of Search ..... 139/66 R, 68, 71, 72

[56] References Cited

U.S. PATENT DOCUMENTS

| | | | |
|---|---|---|---|
| 3,441,060 | 4/1969 | Schwarz | 139/71 |
| 3,665,972 | 5/1972 | Hoenig | 139/68 |
| 3,828,826 | 8/1974 | Hurzeler et al. | 139/68 |
| 3,951,176 | 4/1976 | Kogama | 139/71 |
| 4,182,380 | 1/1980 | Palau | 139/71 |
| 4,385,646 | 5/1983 | Kleiner | 139/68 |

*Primary Examiner*—Henry Jaudon

*Attorney, Agent, or Firm*—Diller, Ramik & Wight

[57] ABSTRACT

The apparatus includes two retaining elements associated with the control elements, two actuating elements associated with the retaining elements, a shaft acting on the actuating elements in order to pivot the latter and to displace them in translatory motion, and an electromagnet which can be optionally energized and deenergized.

The shaft is oscillatingly driven in accordance with the motion of the control element at the timing of the loom. The actuating element is brought into contact with, and out of contact from, the electromagnet independently of the control cycle and is displaced in the direction of the retaining element only when the electromagnet is not energized. The actuating element need therefore be displaced only once during the period of time defined by the clearance S, so that the operating speed of the loom can be increased.

16 Claims, 13 Drawing Figures

Fig. 2
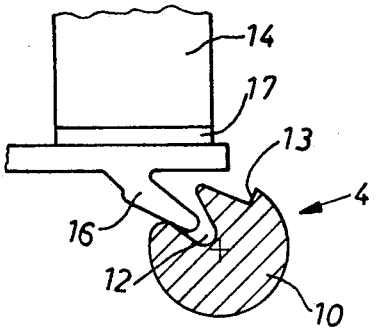
Fig. 3
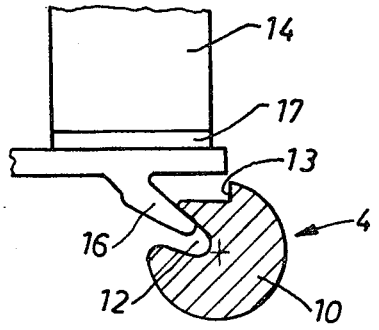
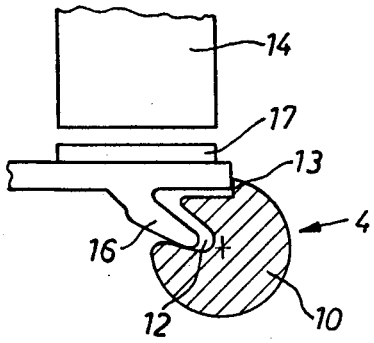
Fig. 4
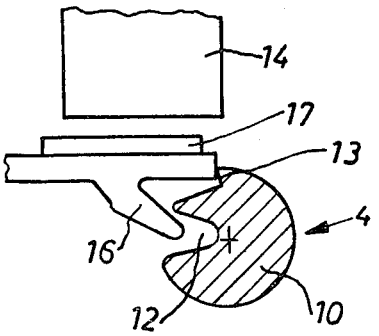
Fig. 5

APPARATUS FOR THE OPTICAL RETENTION OF THE TWO RECIPROCATINGLY DRIVEN CONTROL ELEMENTS OF THE SHED FORMING ARRANGEMENT ASSOCIATED WITH A LOOM

BACKGROUND AND SUMMARY OF THE INVENTION

The invention relates to apparatus for the optional retention of the two reciprocatingly driven control elements of the shed forming arrangement associated with a loom.

A known shed-forming arrangement having such apparatus is disclosed in Swiss Patent Specification No. 543 127. Each such apparatus is associated with a control element and comprises an electromagnet, which is energized in accordance with a control programme, a retaining element, which is pivotable about a stationary shaft and constructed as the armature of the electromagnet, and an actuating device with two actuating elements and with a control mechanism which is actuated in accordance with the motion of the control element at the operating timing of the loom, in order to actuate the retaining element.

The armature is placed upon the electromagnet by the control mechanism, actuated at the timing of the loom, and by an actuating element. If the electromagnet is energized, the armature is held and the retaining element does not influence the reciprocatingly moving control element until the armature is drawn off the electromagnet by the control mechanism and by the second actuating element, whereupon the reciprocating control element is retained. If the electromagnet is not energized, the armature is directly pulled off the electromagnet by a spring.

The retaining element therefor performs a reciprocating motion which is defined by the operating timing of the loom, i.e., it operates in a cycle defined by the control mechanism and by the two actuating elements.

The reciprocating motion must be performed within a time which depends on the clearance that occurs between the hook portions of the retaining element and of the control element in its lowest position. In other words, the velocity of the control element is dependent on the time of one reciprocating motion of the retaining element. The operating speed of the loom is thus restricted, which is a disadvantage.

Another disadvantage is due to the fact that relatively large accelerating forces occur due to the rapid reciprocating motion of the retaining element. As a result, both the armature and the electromagnet can be damaged, on the one hand due to the severe impact of the armature so that the loom is subject to malfunctioning, and on the other hand it is necessary for a heavier construction to be adopted for the loom.

The contact time for the armature is very short owing to the rapid reciprocating motion of the retaining element. The magnetic field to be produced by the electromagnet must be correspondingly powerful, so that the electromagnet must be designed for a higher power, which is also a disadvantage.

It is here that the invention provides a remedy. The invention solves the problem of providing an apparatus of the initially mentioned kind, in which the actuating element is brought into contact with, and out of contact from, the control device, independently of the control element cycle, and is able to scan the magnetic field and is displaced in the direction of the retaining element only when the control device is not energized.

The advantages thus achieved are that the time for scanning the magnetic field and preparation of the actuating element for pivoting is independent of the control element cycle so that practically an entire control element cycle is available for scanning the magnetic field and that the retaining element is moved in only one direction during the period of time which depends on the clearance. The accelerating forces are thus reduced or the velocity of the actuating elements or of the control elements can be increased.

In one exemplied embodiment of the invention, the control apparatus contains two electromagnets and the driving mechanism comprises two shafts each of which is associated with a stationary shaft. The retaining element is retained on the one hand on the shaft and on the other hand is in engagement with the shaft so that the actuating element can be brought into contact with or out of contact from the electromagnet by means of the shaft.

This offers the advantage that the retaining element need only perform a retaining function and can thus be made less strong while the low accelerating forces and the elasticity of the actuating element substantially avoid damage thereof or of the electromagnet.

In a preferred embodiment of the invention the control device comprises an electromagnet and the driving mechanism only one shaft which is associated with two stationary shafts. Two actuating elements are provided symmetrically with respect to the shaft and are retained on the one hand on one spindle and on the other hand are in engagement with the shaft. The actuating elements are alternately brought into contact with, and out of contact from, the electromagnet and each is displaced when the electromagnet is not energized.

This embodiment offers the advantage that only one electromagnet and one shaft is required so that the apparatus is substantially simplified and power consumption of the apparatus can be substantially reduced.

It is also advantageous if the actuating elements are components of U-shaped configuration, because these components can merely be slid on to the stationary axle so that installation and more particularly repair can be greatly simplified.

Another advantage is due to the fact that the retaining element is a leaf spring so that the mass of the retaining element is greatly reduced and accelerating forces become correspondingly small.

BRIEF DESCRIPTION OF THE DRAWINGS

FIGS. 2 to 5 show individual positions of elements of the apparatus shown in FIG. 1 during operation;

DETAILED DESCRIPTION OF THE PREFERRED EMBODIMENT

The apparatus described herein is part of a shed forming arrangement with two control elements which can reciprocate in push-pull operation between two limiting positions. Each control element is associated with a retaining element which optionally and in accordance with a control programme retains the associated control element in one limiting position. No description is given of the shed forming arrangement since this is not the subject of the present invention.

Figure 1:
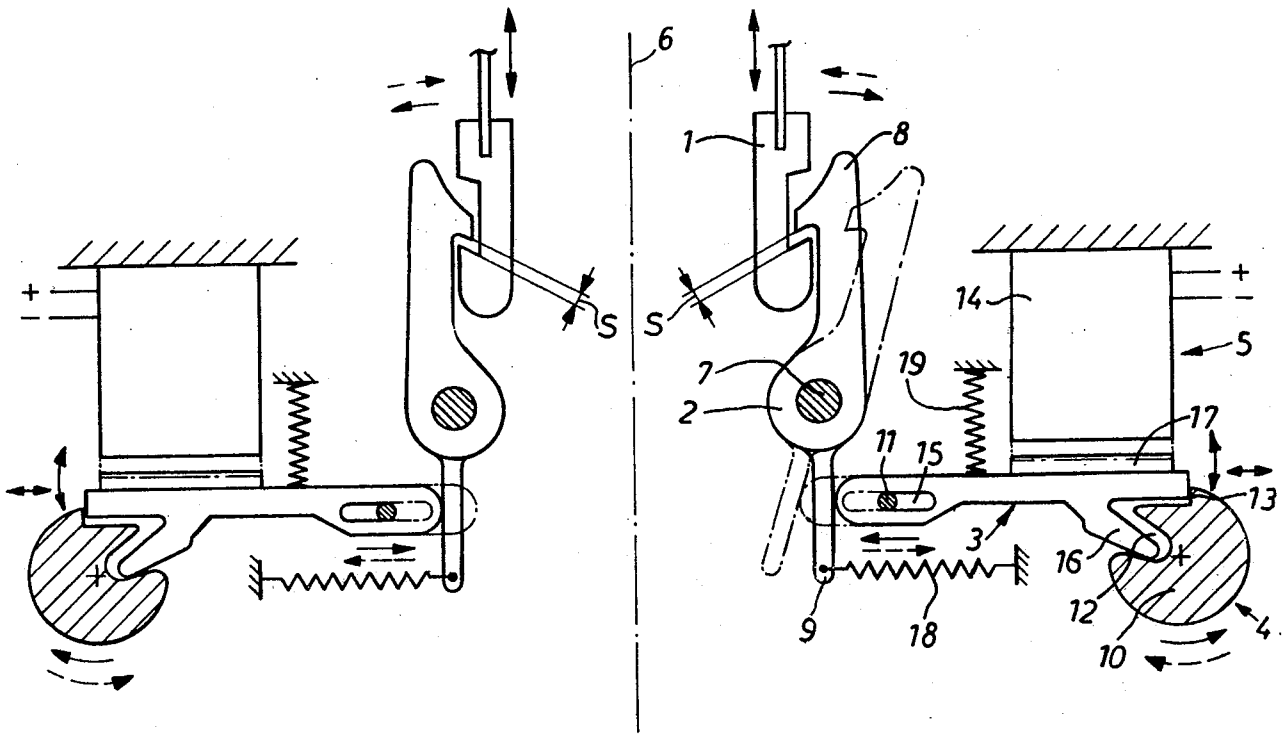
FIG. 1 is a first embodiment of the apparatus according to the invention.

As shown in FIG. 1, the two control elements 1 are associated with the apparatus for retaining the control elements. This embodiment comprises two sub-assemblies, each having a retaining element 2, an actuating element 3, a driving mechanism 4 and a control device 5 with the sub-assemblies disposed in axially symmetrical configuration with respect to an imaginary plane 6. In the interest of simplicity, only one sub-assembly will be described in detail hereinbelow.

The retaining element 2 is constructed as a two-armed lever, adapted to pivot about a stationary shaft 7. One lever arm is constructed as a retaining hook 8, which can be brought into engagement with the control element 1, and the second lever arm is constructed as an extension 9.

The actuating element 3 is pivotable and arranged to slide in translatory motion and is actuated by the driving mechanism.

The driving mechanism includes a shaft 10 which is oscillatingly driven by the loom via a machine element which is not shown. The shaft 10 is associated with a non-rotational spindle 11, situated parallel with the shaft 10. A recess 12 and a projection 13 are formed in the shaft 10 and extend along the longitudinal axis thereof.

The control device comprises an electromagnet 14 which is energized and de-energized in accordance with the control programme of the loom.

The actuating element 3 is retained on the one hand on the non-rotational spindle 11 and on the other hand is in engagement with the shaft 10 in order to pivot the actuating element 3 and to slide it in translatory configuration. The actuating element 3 is a rod-shaped member, one end of which is provided with a slot 15 and the region of the other or second end is provided with a portion 16 formed thereon. The slot 15 extends along the longitudinal axis of the member while the integrally formed portion projects at an angle from one side of the member in the direction towards said other end.

The actuating element 3 is arranged so that the end retained on the spindle 11 bears on the projection 9 of the retaining element 2, the portion 16, extending at an angle, projects into the recess 12 of the shaft 10 and the second end can be brought into contact with the projection 13.

The actuating element 3 can be constructed of magnetizable material, for example steel, or of plastics. If the actuating element 3 is of plastics, a magnetizable member 17 will be provided, which is disposed on the side situated opposite to the integrally formed portion 16. The magnetizable member 17 can be constructed of any suitable material, for example soft iron, which is attached by suitable fastening means, for example adhesive, on the actuating element 3. The magnetizable member 17 can also be partially cast into the actuating element.

If an electrostatically operating element is provided in place of the electromagnet 14, an electrically conductive member is provided in place of the magnetizable member 17 and is connected through conductors not shown to the control device.

Each actuating element 3 is also associated with two springs 18 and 19. One spring is a tension spring which is secured, on the one hand on the machine frame not shown, and on the other hand on the extension 9 of the retaining element 2 in order to pull the latter against the actuating element and to move the retaining element into the first position. The second spring 19 is a compression spring which is attached, on the one hand, on the machine frame not shown, and on the other hand on the actuating member 3 in order to thrust the latter away from the electromagnet 14 and to maintain it in contact with a shaft.

The operation of the device will be described hereinbelow by reference to FIGS. 2 to 5. As already mentioned, the control elements are reciprocated in push-pull operation, the driving mechanism is oscillatingly driven by the loom drive and the control device is controlled in accordance with a control programme.

In the apparatus illustrated in FIG. 1, one retaining element is in a first position in which it projects into the path of motion of the control element 1. In this case, the retaining element 2 is retained in the first position by the force of the spring 18 acting on the projection 9 and the actuating element 3 is retained by the projection 9 in the pushed back position.

It may be assumed that the shaft 10 rotates in the clockwise direction into the limiting position. As shown, in FIG. 2, the magnetizable member 17 bears on the electromagnet 14 in this position. If the electromagnet is energized at this time, the actuating element 3 will be retained in this position. The shaft 10 then rotates in the anti-clockwise direction. If the retaining element 3 continues to be retained on the electromagnet 14, the shaft 10 is brought into contact with the portion 16 formed integrally on the actuating element 3 and the actuating element 3 or the magnetizable member 17 is pulled off the electromagnet 14 by the shaft 10 rotating in the anti-clockwise direction. As shown in FIG. 3, pulling off takes place at a time at which the projection 13 of the shaft 10 is no longer brought into contact with the actuating element, so that the latter is merely pivoted about the spindle 11 and is not displaced in the direction of the retaining element 2. Accordingly, the retaining element remains in its first position.

If the electromagnet 14 is not energized, in contrast to the previously described case, the actuating element 3 is maintained in contact by the compression spring 19 with the shaft 10 in anti-clockwise rotation, i.e. it is thrust away from the electromagnet 14. As may be seen by reference to FIG. 4, after approximately a half revolution of the shaft 10 in the anti-clockwise direction, the end of the actuating element 3 is brought into contact with the projection 13 on the shaft 10. As a result of further rotation of the shaft 10, the actuating element 3 is then pushed forward in the direction of retaining element 2 by the force of the compression spring 19 and the retaining element 2 is pivoted about the shaft 7 until the shaft 10 reaches its limiting position shown in FIG. 5. In this position, the retaining element is moved into the second position, i.e. out of the path of motion of the control element 1, so that the retaining element 2 releases a previously retained control element 1 or no longer retains a control element 1 which is moved into the second limiting position. The shaft 10 then again rotates in the clockwise direction until it reaches its limiting position, shown in FIG. 2, via the position shown in FIG. 4. This rotation of the shaft again causes the tension spring 18 to pivot the retaining element 2 again into its first position. This completes the operating cycle.

As may be seen by reference to the description above, placing the actuating element 3 upon the electromagnet 14 is independent of the control element cycle and the actuating element 3 need be moved in only one direction during the time corresponding to the clearance S between the control element 1 in its second position and the retaining element 2 situated in its first position.

Figure 6:
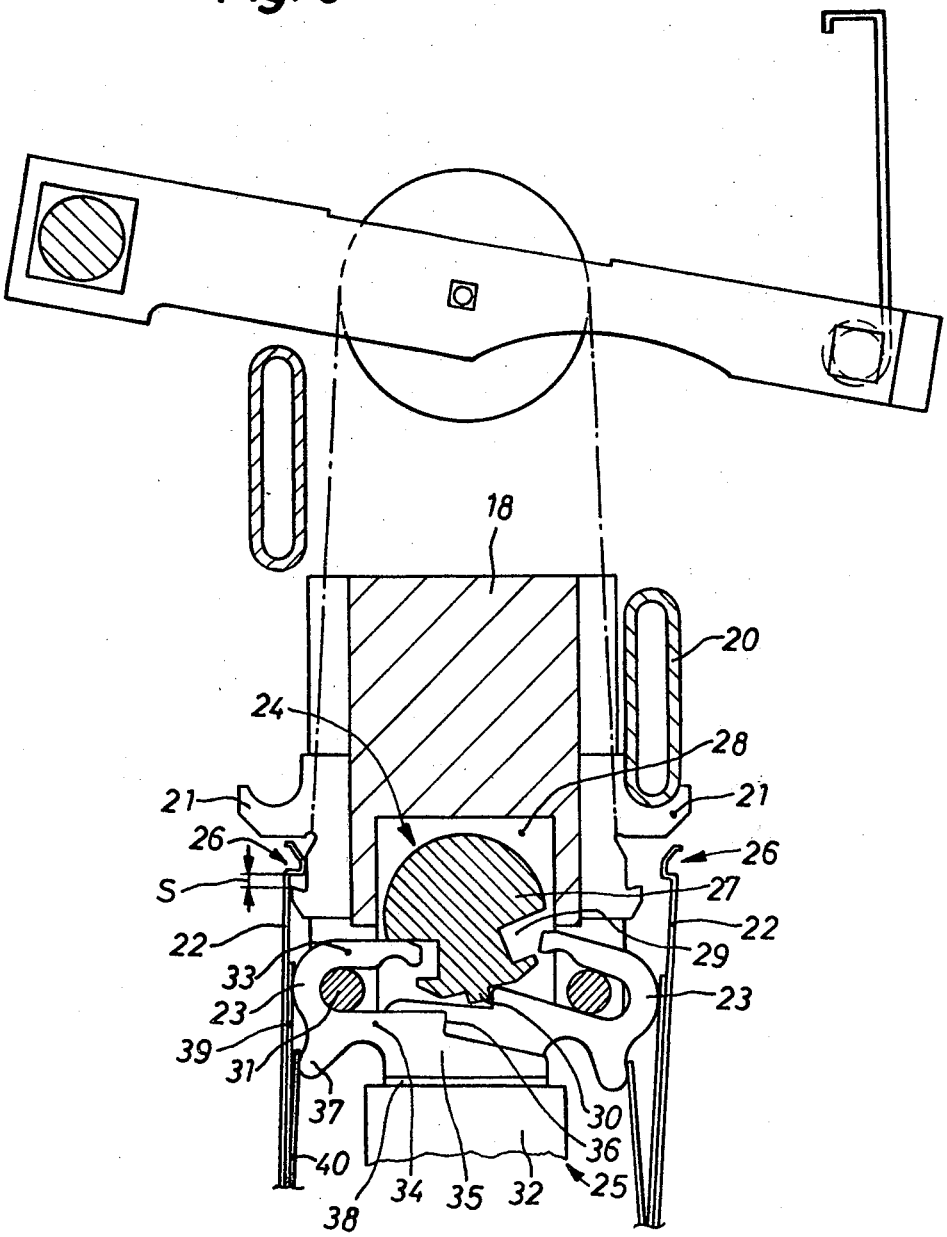
FIG. 6 shows another embodiment of the apparatus according to the invention.

FIG. 6 shows one preferred exemplified embodiment of the apparatus according to the invention. The apparatus is disposed on a support member 18 of the loom. On oppositely disposed sides the support member 18 is provided with slots 19 in which the reciprocatingly driven control elements 21 are guided. The control elements are actuated by members 20 which are constructed as flat oval tubes in order to reduce the mass. The apparatus comprises two retaining elements 22 each associated with the control elements, two actuating elements 23, each associated with the retaining elements 22, a driving mechanism 24 adapted to actuate the two actuating elements 23 in push-pull operation and a control device 25 by means of which the actuating elements 23 are alternatingly brought into contact.

The retaining elements 22 are leaf springs, mounted opposite each other on one end of the support member 18. Each second end of the leaf spring is constructed as a retaining hook 26 which can be brought into engagement with the control element 21 in order to retain this in the second position.

The driving mechanism 24 comprises a shaft 27 disposed in a recess 28 of the support member 18 and is oscillatingly driven by the loom drive via machine elements not shown. The shaft 27 has two recesses 29 and a projection 30 extending along the longitudinal axis of the shaft 27 and is of axially symmetrical cross-section. The shaft 27 is associated with two spindles 31 which are non-rotationally mounted on the support member 18, parallel with and symmetrical to the shaft 27.

The control device 25 is provided with an electromagnet 32 which is energized and de-energized in accordance with the control programme of the loom and is mounted at a distance beneath the shaft 27 on the support member 18.

The two actuating elements 23 are retained on the one hand on a spindle 31 and on the other hand can be brought into engagement with a recess 29 of the shaft 27 in order to pivot the actuating elements 23 in push-pull operation and to slide them in translatory motion. The actuating element 23 is a flat member, substantially of U-shaped configuration with a half round yoke portion whose internal radius is adapted in accordance with the spindle 31. The inside of one member 33 is provided with a half round recess while an elongated portion 35 is integrally formed on the outside of the second member 34, so that a shoulder is formed and a nose 37 is integrally formed in the region between the member 34 and the yoke portion.

The two members of the U-shaped configuration are arranged symmetrically with respect to the shaft 27, so that each member of U-shaped configuration is retained on a spindle 31, one member 33 is insertable into the recess 29 to pivot the member of U-shaped configuration about the spindle 31 and the shoulder 37, formed on the second member 34, can be brought into contact with the projection 30 of the shaft 27 in order to slide the member of U-shaped configuration. The actuating element 23 is constructed of plastics and is provided with a magnetizable member 38, disposed on the edge of the elongated portion 35, so that the magnetic member 38 is exposed on the edge and on one side of the portion 35 and the second side of the portion 35 is at least partially covered. This offers the advantage that the magnetizable members 38 of the symmetrically arranged actuating elements are spaced from each other by being partially covered and can thus influence each other to a lesser extent. The magnetizable member 38 can be constructed of soft iron. The actuating element 23 can also be constructed of magnetizable material, for example steel.

Furthermore, two springs 39,40 are associated with each actuating element 23. The springs 39,40 are leaf springs which, together with the retaining elements 22, are mounted on the support member 18 and are designed so that one spring 39 bears on the outside of the yoke portion associated with the member of the U-shaped configuration in order to thrust it against the spindle 31 and that the second spring 30 bears upon the nose 37 in order to maintain this in contact with the shaft 27.

The operation of the device illustrated in FIG. 6 will now be described by reference to FIGS. 7 to 13. The shaft 27 and the electromagnet are driven and energized or de-energized by analogy with the exemplified embodiment illustrated in FIG. 1.

Figure 7:
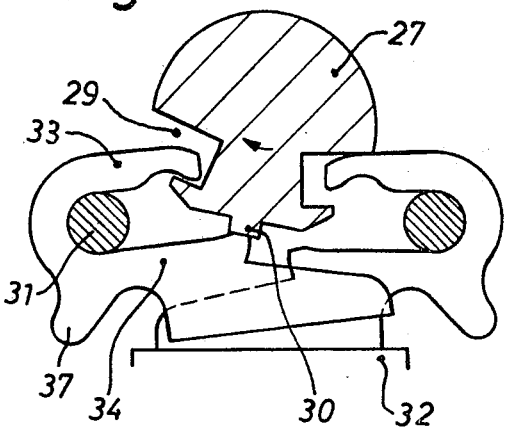
FIGS. 7 to 13 show individual positions of elements of the apparatus shown in FIG. 6 during operation.
Figure 9:
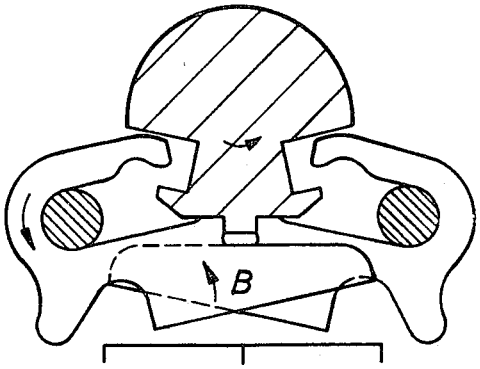
Figure 8:
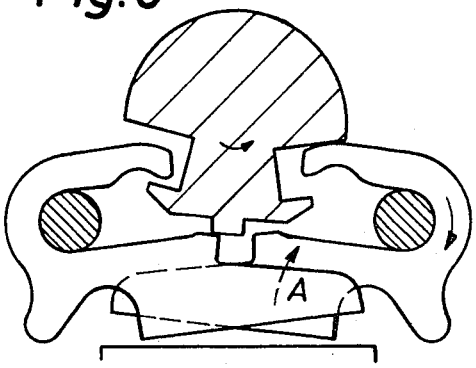

In the position illustrated in FIG. 7, the shaft 27 has rotated in the clockwise direction into its limiting position. In this position, the left actuating element 23 is lifted off the electromagnet 32 by virtue of the leaf spring 40 acting on the nose 37, which said leaf spring imparts torque to the actuating element 21 and the first-mentioned actuating element is thrust against the projection 30 of the shaft 27 and the right hand actuating element is thrust by the shaft 27 on to the electromagnet 32 against the force exerted by the spring 40.

Figure 10:
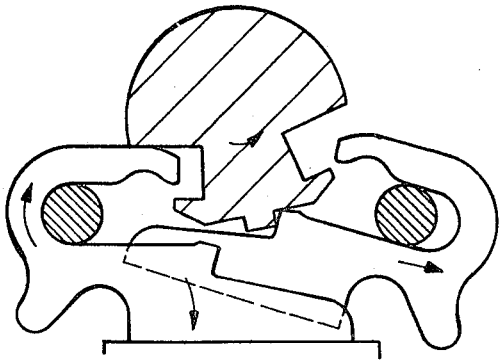

It may be assumed that the electromagnet 32 is not energized when the shaft 27 is in this position. If the shaft 27 is then rotated in the anti-clockwise direction, the right hand actuating element is pivoted about the spindle 31 by virtue of the force exerted by the spring 40 and owing to the position of the corresponding recess 29 being altered by the rotation of the shaft 27, as indicated by the arrow A in FIG. 8, and said element is thus lifted off the electromagnet 32 while the left-hand actuating element 23 initially retains its position. If the shaft reaches the middle position shown in FIG. 9, the left and right actuating elements bear on the shaft 27 on both sides of the projection 30, and the left-hand actuating element is pivoted by the force of the spring 40 about the spindle 31 into this position which is illustrated by the arrow B. Owing to the rotating shaft, the projection 30 is brought into contact with the shoulder 36 of the right-hand actuating element. Subsequently, the shaft displaces the right-hand actuating element in the direction of the retaining element and at the same time the left-hand actuating element is pivoted by the shaft about the spindle until the shaft is rotated into the second limiting position as illustrated in FIG. 10. In this limiting position, the shaft 27 has moved one retaining element 22 out of the path of motion of the control element 21 by means of the left-hand actuating element, as illustrated in FIG. 6. As can be seen by reference to FIGS. 7 to 10, during this rotation of the shaft 27 the left-hand actuating element was merely pivoted, so that the second retaining element 22 projects into the path of motion of the control element 21.

Figure 11:
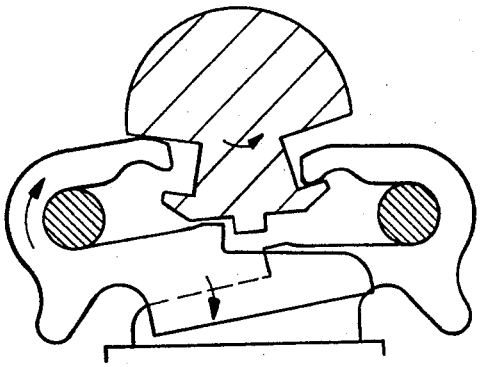
Figure 12:
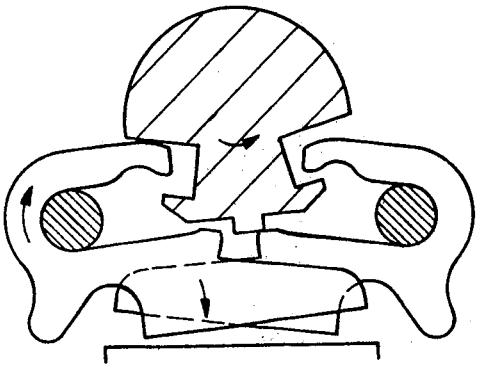
Figure 13:
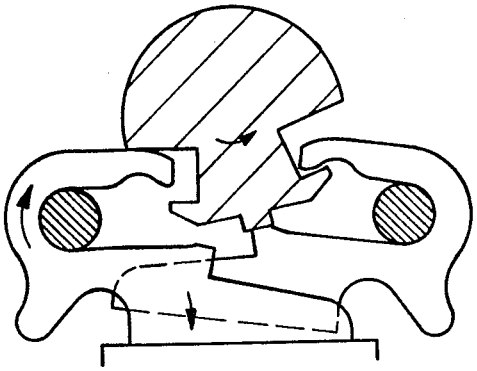

It may be assumed that in the position of the shaft shown in FIG. 7 the electromagnet 32 is energized. If the shaft is rotated in the anti-clockwise direction, the left-hand actuating element will be moved as described previously, thus dispensing with the need for further description, and the right-hand actuating element is retained on the electromagnet 32. The right-hand actuated element is pulled off the electromagnet 32 by virtue of the shaft rotating in the anti-clockwise direction. As shown in FIG. 11, this pull-off operation occurs at a time at which the projection 30 of the shaft 27 is no longer brought into contact with the shoulder 36. As shown in FIG. 12, the right-hand actuating element bears on the projection 30 and is pivoted about the axle 31 by virtue of the force exerted by the spring 40. No displacement of the actuating element takes place in the direction of the retaining element, as can be seen by reference to FIG. 13.

We claim:

1. Apparatus for the optical retention in one of the limiting positions of two reciprocatingly driven control elements of a shed forming arrangement associated with a loom, comprising retaining elements associated with the control elements and adapted to be moved from a first position into a second position and projecting in one position into the path of motion of the control elements in order to retain these in one limiting position, an actuating means with actuating elements adapted to act on the retaining elements, a drive mechanism associated with the actuating elements adapted to move the retaining elements from the first into the second position, an electrically energizable control device for the selective control of the actuating elements, the actuating elements having an elongated slot, and wherein there is provided a pivot pin projecting into said slot such to allow a pivoting and translatory sliding motion of said actuating elements in order to move them into and out of contact with the control device and to slide the actuating elements towards the retaining elements when the control device is not energized.

2. Apparatus according to claim 1, wherein the driving mechanism comprises at least two oscillatingly driven shafts in order to move the actuating elements in push-pull operation and the control device is provided with two electrodynamically or electrostatically acting retaining elements on each of which an actuating element can be placed in order to retain or not to retain the contacting actuating element.

3. Apparatus according to claim 2, wherein the shaft is provided with at least one recess and at least one projection which extends along the longitudinal axis of the shaft and the shafts are so arranged that the recesses and the projections are axially symmetrical with respect to an imaginary plane between the shafts.

4. Apparatus according to claim 2, wherein each shaft is associated with a non-rotational spindle situated parallel with the shaft and the actuating elements on the one hand are each retained on a spindle and on the other hand project into the recess of a shaft in order to move the actuating elements.

5. Apparatus according to claim 4, wherein the actuating element is a rod-shaped member, the end of which is provided with a slot in order to retain the actuating element on the spindle and the region of the second end of said rod-shaped member is provided with an integrally formed portion which projects laterally and the actuating element is disposed on the appropriate spindle so that the laterally projecting portion extends into the recess of the shaft and the second end of the part can be brought into contact with, or out of contact from, the projection of the shaft and a portion of the part can be brought into contact with, or out of contact from, the retaining element and wherein when the retaining element is energized, the shaft acts on the portion which extends into the recess in order to pivot the actuating element and in order to bring a portion of the part into contact with, or out of contact from the retaining element and, when the retaining element is not energized, acts on the second end of the part in order to slide the actuating element in the direction of the retaining element.

6. Apparatus according to claim 5, wherein the actuating element is associated with two springs so that one spring acts via the retaining element on to the first-mentioned end of the rod-shaped member in order to slide back the actuating element which is displaced in the direction of the retaining element and to thrust against its spindle and the second spring acts on the rod-shaped element in order to pivot the actuating element and to retain it in contact with its shaft.

7. Apparatus according to claim 5, wherein the actuating element is provided with an electrically polarizable or magnetizable member which is disposed on the rod-shaped member and can be brought into contact with the retaining element.

8. Apparatus according to claim 1, wherein the driving mechanism is provided with one oscillatingly disposed shaft in order to move the actuating elements in push-pull configuration and that the control device is provided with an electrodynamically or electrostatically acting retaining element against which the actuating elements can be brought to bear, so that said elements can be retained or not by said retaining element.

9. Apparatus according to claim 8, wherein the shaft is of axially symmetrical cross-section and at least two recesses and one projection are formed in the shaft and extend along the longitudinal axis thereof.

10. Apparatus according to claim 9, wherein the shaft is associated with two non-rotational spindles which are arranged parallel and symmetrically with the shaft, and each of the actuating elements is disposed on the one hand on a spindle and on the other hand projects into each recess of the shaft and can be brought to contact with, and out of contact from, the projection of the shaft in order to move the actuating elements.

11. Apparatus according to claim 8, wherein the actuating element is a flat member of U-shaped configuration in order to retain the actuating element on the spindle and the actuating element is so disposed on the spindle, that a member projects into a recess of the shaft, the second member can be brought into contact with, or out of contact from, the retaining element so that a shoulder provided on the second member, can be brought into contact with, and out of contact from, the projection of the shaft and, when the retaining element is energized, the shaft acts on the member projecting into the recess in order to pivot the actuating element and to bring the second member into contact with, or out of contact from, the retaining element, and, when the retaining element is not energized, acts on the shoulder in order to move the actuating element in the direction of the retaining element.

12. Apparatus according to claim 11, wherein the actuating element is associated with two springs in such a way, that one spring acts on the U-shaped member in order to slide back the actuating element, which has been displaced in the direction of the retaining element, and to thrust against the spindle, and that the second spring acts on the U-shaped member in order to pivot the actuating element and to bring it into contact with the spindle.

13. Apparatus according to claim 11, wherein the actuating element is provided with an electrically polarizable or magnetizable member, which is disposed on the U-shaped member and can be brought into contact with the retaining element.

14. Apparatus according to claim 11, wherein the retaining element is a leafspring.

15. Apparatus according to claim 2 or 8, wherein the retaining element is an electromagnet.

16. Apparatus according to claim 7 or 13, wherein the magnetizable part comprises soft iron.

* * * * *